US011815107B2

(12) United States Patent
Niwa

(10) Patent No.: US 11,815,107 B2
(45) Date of Patent: Nov. 14, 2023

(54) FLUID CONTROL DEVICE

(71) Applicant: SHIMADZU CORPORATION, Kyoto (JP)

(72) Inventor: Michihiro Niwa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 396 days.

(21) Appl. No.: 17/293,906

(22) PCT Filed: Nov. 14, 2018

(86) PCT No.: PCT/JP2018/042158

§ 371 (c)(1),
(2) Date: Jul. 16, 2021

(87) PCT Pub. No.: WO2020/100236

PCT Pub. Date: May 22, 2020

(65) Prior Publication Data

US 2022/0003249 A1 Jan. 6, 2022

(51) Int. Cl.
*F15B 11/16* (2006.01)
*B66F 9/22* (2006.01)

(52) U.S. Cl.
CPC ..... *F15B 11/163* (2013.01); *B66F 9/22* (2013.01); *F15B 2211/30555* (2013.01);
(Continued)

(58) Field of Classification Search
CPC ..... F15B 11/163; F15B 2211/6054; F15B 2211/6055; B66F 9/22
See application file for complete search history.

(56) References Cited

U.S. PATENT DOCUMENTS 5,193,342 A * 3/1993 Omberg ..... F15B 11/165 91/518
5,890,362 A 4/1999 Wilke
(Continued)

FOREIGN PATENT DOCUMENTS

EP 0664401 7/1995
EP 0911529 4/1999
(Continued)

OTHER PUBLICATIONS

"Search Report of Europe Counterpart Application", dated May 25, 2022, p. 1-p. 6.
(Continued)

*Primary Examiner* — Reinaldo Sanchez-Medina
(74) *Attorney, Agent, or Firm* — JCIPRNET

(57) ABSTRACT

When a fluid control valve is opened and closed, the port pressure of fluid control valve is guided to a main relief valve through a first passage, and its maximum pressure is controlled by the main relief valve. At the same time, the port pressure of fluid control valve is guided to pressure compensation valves of the respective fluid control valves. As a result, even when functions having different load pressures are simultaneously operated in the fluid control valves, constant operability can be always secured without depending on the load pressures. In addition, when the fluid control valve, which drives a tilt cylinder for a function of tilting a fork, is opened and closed, the port pressure of the fluid control valve is guided to a secondary relief valve through a second passage, and is also guided to the main relief valve and the pressure compensation valves of the respective fluid control valves through the first passage.

4 Claims, 3 Drawing Sheets

(52) U.S. Cl.
CPC ..... *F15B 2211/3111* (2013.01); *F15B 2211/6054* (2013.01); *F15B 2211/6055* (2013.01)

(56) References Cited

U.S. PATENT DOCUMENTS

| | | | | |
|---|---|---|---|---|
| 6,318,079 | B1 * | 11/2001 | Barber | F15B 11/163 60/489 |
| 10,557,484 | B2 | 2/2020 | Kuromusha | |
| 2004/0020082 | A1 * | 2/2004 | Ariga | E02F 9/2235 37/236 |
| 2007/0235078 | A1 * | 10/2007 | Brockmann | F15B 11/162 137/2 |
| 2015/0101676 | A1 | 4/2015 | Knapper | |
| 2018/0202472 | A1 | 7/2018 | Kuromusha | |
| 2018/0347153 | A1 * | 12/2018 | Hatanaka | F15B 11/165 |
| 2021/0324609 | A1 * | 10/2021 | Takahashi | E02F 9/2285 |

FOREIGN PATENT DOCUMENTS

| | | |
|---|---|---|
| EP | 2863068 | 4/2015 |
| FR | 2757222 | 6/1998 |
| JP | H11210705 | 8/1999 |
| WO | 2017006417 | 1/2017 |

OTHER PUBLICATIONS

"Notification of Granting of China Counterpart Application", dated Mar. 1, 2023, with English translation thereof, p. 1-p. 3.
"Written Opinion of the International Searching Authority (Form PCT/ISA/237) of PCT/JP2016/042158", with partial English translation thereof, dated Feb. 5, 2019, pp. 1-6.
"International Search Report (Form PCT/ISA/210) of PCT/JP2018/042158", with English translation thereof, dated Feb. 5, 2019, pp. 1-2.
"Notice of Allowance of European Counterpart Application," dated Jul. 21, 2023, pp. 1-28.

* cited by examiner

FLUID CONTROL DEVICE

CROSS-REFERENCE TO RELATED APPLICATION

This application is a 371 application of the international PCT application serial no. PCT/JP2018/042158, filed on Nov. 14, 2018. The entirety of the above-mentioned patent application is hereby incorporated by reference herein and made a part of this specification.

TECHNICAL FIELD

The present invention relates to a fluid control device of a closed center circuit type including a plurality of fluid control valves.

DESCRIPTION OF RELATED ART

In such a fluid control device having a configuration in which a plurality of fluid control valves are arranged in a row, a relief valve is used to prevent the liquid pressure of a hydraulic fluid from excessively increasing. For example, in a fluid control device used for a forklift, a relief valve corresponding to the maximum pressure is used for an area requiring the maximum pressure with respect to the hydraulic fluid for a lifting function or the like, and for each area with a lower liquid pressure of the hydraulic fluid than the maximum pressure, a respectively corresponding relief valve is provided. For this reason, a relief valve is required for each function, and thus the device becomes complicated and large, and the device cost increases.

For this reason, a fluid control device employing both a main relief valve and a secondary relief valve is also used. Patent Literature 1 discloses a fluid control device of an open center circuit type in which fluid control valves corresponding to a plurality of functions are arranged in a row, in which the port pressure of a fluid control valve corresponding to a function requiring the maximum pressure is guided to a main relief valve, and the port pressures of a plurality of fluid control valves corresponding to the other functions are guided to a secondary relief valve.

In a configuration in which the hydraulic fluid from a single liquid pressure source is supplied to fluid control valves corresponding to a plurality of functions, when a plurality of functions are simultaneously used, a phenomenon occurs in which the response speed changes according to the load of each function. For example, in a case where such a fluid control device is used for a forklift and a plurality of functions are simultaneously executed, such as the raising of a lift and backward tilting, since the hydraulic fluid preferentially flows into a function with a smaller load, a phenomenon occurs in which the operation of a function with a large load is delayed, whereas the operation of a function with a small load is accelerated. When such a phenomenon occurs, the operability by an operator is not constant.

To address such a problem, Patent Literature 2 proposes a pressure-compensator-equipped liquid pressure control valve device of a closed center circuit type including pressure compensation valves. The device described in Patent Literature 2 includes a pressure compensation valve for each fluid control valve, and the pressure of the hydraulic fluid having the highest load pressure among functions is guided to the pressure compensation valves through a load sensing passage. The difference between the highest pressure and the port pressure is always constant as long as the differential pressure of each pressure compensation valve is the same, and thus the flowrate of the hydraulic fluid guided to a port is determined according to the spool opening degree of each fluid control valve. As a consequence, even when functions having different load pressures are simultaneously operated, constant operability can be always secured without depending on the load pressures.

REFERENCE LIST

Patent Literature

Patent Literature 1: WO 2017/006417 A
Patent Literature 2: JP H11-210705 A

SUMMARY OF INVENTION

Technical Problem

Even with the fluid control device of the closed center circuit type as described in Patent Literature 2, there is a demand for controlling the pressure of the hydraulic fluid with a plurality of fluid control valves in a simple configuration by using the main relief valve and the secondary relief valve as described in Patent Literature 1.

In this case, in the fluid control device of the closed center circuit type including the pressure compensation valves, in order to control the pressure of the hydraulic fluid in the plurality of fluid control valves using the main relief valve and the secondary relief valve, each pressure compensation valve needs to be provided with a load sensing passage for guiding pressure to a function having the largest load pressure among the plurality of fluid control valves and a secondary relief passage for guiding the maximum pressure of functions other than the function requiring the maximum pressure among the plurality of fluid control valves to the secondary relief valve. In order to provide these passages, not only the size of the entire fluid control device including the plurality of fluid control valves increases, but also the number of parts increases and the number of assembling steps increases accordingly.

The present invention has been made to solve the problems described above, and an object of the present invention is to provide a fluid control device capable of controlling the pressure of a hydraulic fluid using both a main relief valve and a secondary relief valve without complicating a device configuration even in a fluid control device of a closed center circuit type including pressure compensation valves.

Solution to Problem

In an invention according to claim 1, a fluid control device of a closed center circuit type having a configuration in which a plurality of fluid control valves are arranged in a row, the fluid control valves each including a body having a port connected to an actuator, a flowrate adjusting member configured to adjust a flowrate of a hydraulic fluid passing through a flow path formed in the body, and a pressure compensation valve, the fluid control device including: a main relief valve corresponding to a pressure of a hydraulic fluid supplied to a fluid control valve having a maximum load pressure among the plurality of fluid control valves; a secondary relief valve corresponding to a pressure of a hydraulic fluid supplied to a plurality of fluid control valves other than the fluid control valve having the maximum load pressure among the plurality of fluid control valves; a first passage connecting a load handling line of the fluid control valve having the maximum load pressure among the plurality of fluid control valves, the main relief valve, and the pressure compensation valves in the plurality of respective fluid control valves; a second passage connecting load handling lines of the plurality of fluid control valves other than the fluid control valve having the maximum load pressure among the plurality of fluid control valves and the secondary relief valve; check valves disposed in respective passages connecting the load handling lines of the plurality of fluid control valves other than the fluid control valve having the maximum load pressure among the plurality of fluid control valves and the second passage; and a passage switching unit configured to send a hydraulic fluid having a higher pressure out of the hydraulic fluid in the load handling line of the fluid control valve having the maximum load pressure among the plurality of fluid control valves and the hydraulic fluid in the second passage to the main relief valve and the pressure compensation valves in the plurality of respective fluid control valves through the first passage.

In an invention according to claim 2, along with the invention according to claim 1, the passage switching unit is a shuttle valve having a supply port connected to the second passage and the load handling line of the fluid control valve having the maximum load pressure among the plurality of fluid control valves, and a discharge port connected to the first passage.

In an invention according to claim 3, along with the invention according to claim 1, the passage switching unit includes a check valve disposed between the second passage and the first passage, and a check valve disposed between the load handling line of the fluid control valve having the maximum load pressure among the plurality of fluid control valves and the first passage.

In an invention according to claim 4, along with the invention according to claim 1, the flowrate adjusting member is a spool that moves in the body.

Advantageous Effects of Invention

With the invention according to claims 1 to 4, it is possible to control the pressure of a hydraulic fluid using both a main relief valve and a secondary relief valve without complicating a device configuration even in a fluid control device of a closed center circuit type including pressure compensation valves.

DESCRIPTION OF EMBODIMENTS

Figure 1:
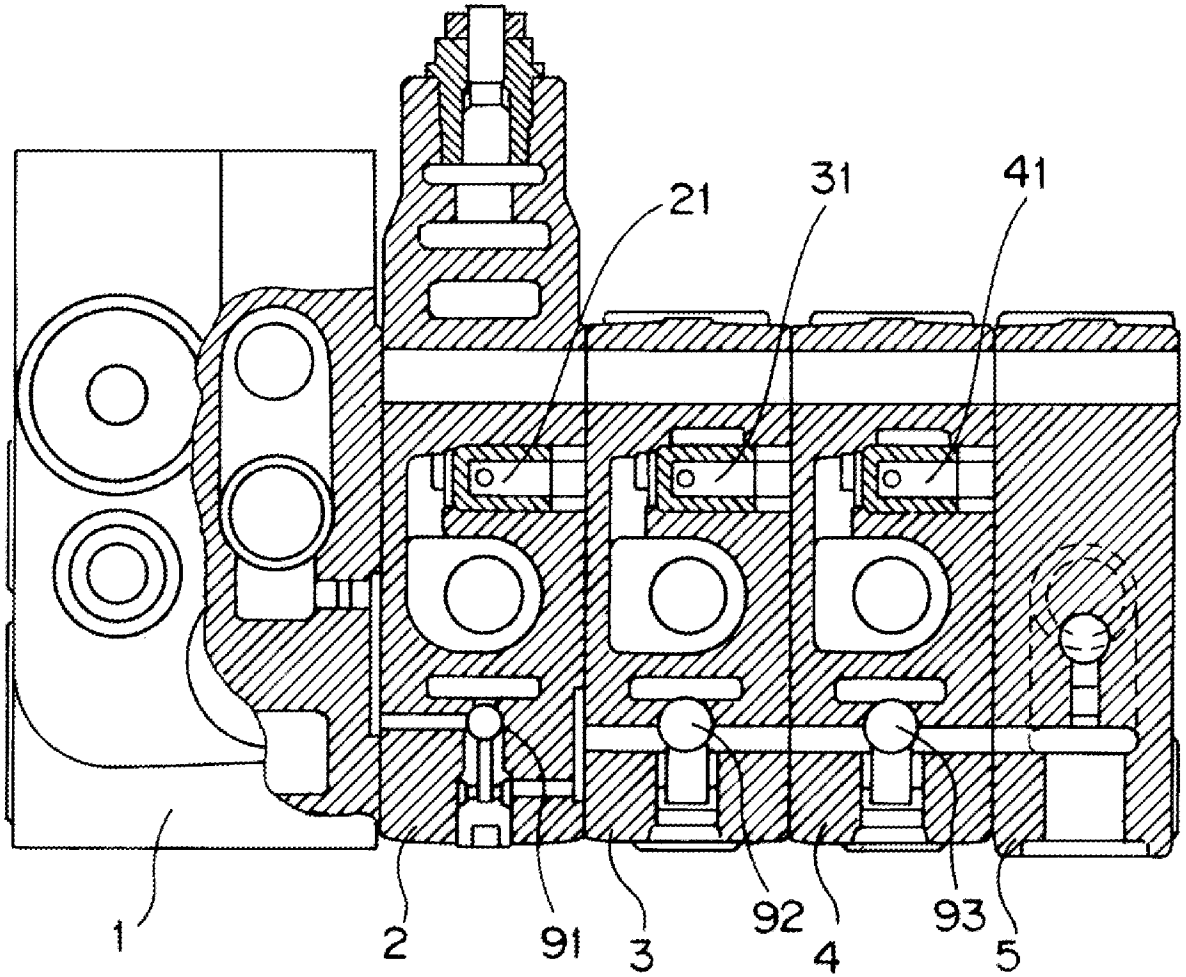
FIG. 1 is a schematic longitudinal sectional view of a fluid control device according to the present invention.
Figure 2:
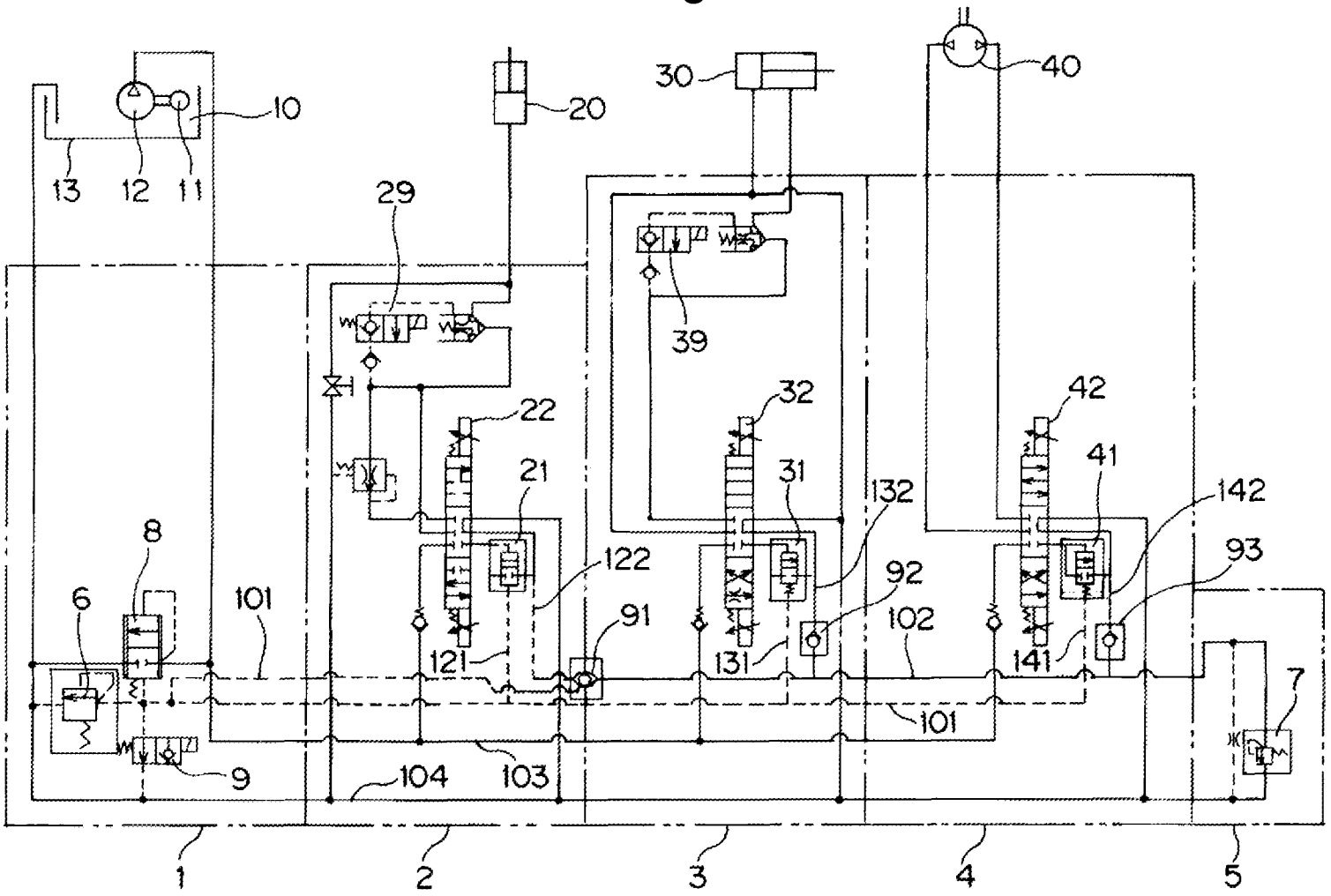
FIG. 2 is a hydraulic circuit diagram in the fluid control device according to the present invention.

Embodiments of the present invention will be described below with reference to the drawings. FIG. 1 is a schematic longitudinal sectional view of a fluid control device according to the present invention. FIG. 2 is a hydraulic circuit diagram in the fluid control device according to the present invention.

This fluid control device uses hydraulic oil as a hydraulic fluid to control the supply of the hydraulic oil to each function of a forklift. This fluid control device has a configuration in which a front cover 1 to which hydraulic oil is supplied from a hydraulic source 10, a fluid control valve (control valve) 2 for supplying hydraulic oil to a lift cylinder 20, a fluid control valve 3 for supplying hydraulic oil to a tilt cylinder 30, a fluid control valve 4 for supplying hydraulic oil to a rotary drive unit 40 for a rotary attachment, and a rear cover 5 are arranged in a row.

The front cover 1 is connected to a hydraulic source 10 including a pump 12 driven by rotation of a motor 11, and also including a tank 13. The high-pressure hydraulic oil supplied from the hydraulic source 10 is supplied to each of the fluid control valves 2, 3, and 4 through a pump passage 103 and is collected through a tank passage 104. The front cover 1 is provided with an unload valve 9 that is closed when a driver sits on a seat surface of the forklift, an unload relief valve 8 for guiding hydraulic oil to the tank 13 when none of the functions of the fluid control valve 2, 3, or 4 is used, and a main relief valve 6.

The fluid control valve 2 is for supplying hydraulic oil to the lift cylinder 20 for raising and lowering a fork of the forklift, and includes a spool 22 as a flowrate adjusting member for controlling the flow of the hydraulic oil, a pressure compensation valve 21, and a lift lock valve 29 as a safety mechanism. In the fluid control valve 2, hydraulic oil is supplied to raise the lift with respect to the lift cylinder 20 when the spool 22 moves upward in FIG. 2, and hydraulic oil is supplied to lower the lift with respect to the lift cylinder 20 when the spool 22 moves downward in FIG. 2.

The fluid control valve 3 is for supplying hydraulic oil to the tilt cylinder 30 for tilting the fork of the forklift, and includes a spool 32 as a flowrate adjusting member for controlling the flow of the hydraulic oil, a pressure compensation valve 31, and a tilt lock valve 39 as a safety mechanism. In the fluid control valve 3, hydraulic oil is supplied to move the lift in the left direction with respect to the tilt cylinder 30 when the spool 32 moves upward in FIG. 2, and hydraulic oil is supplied to move the lift in the right direction with respect to the tilt cylinder 30 when the spool 32 moves downward in FIG. 2.

The fluid control valve 4 is for supplying hydraulic oil to the rotary drive unit 40 for the rotary attachment for rotating the rotary attachment in the forklift, and includes a spool 42 as a flowrate adjusting member for controlling the flow of the hydraulic oil, and a pressure compensation valve 41. In the fluid control valve 4, hydraulic oil is supplied to rotate the rotary attachment in one direction with respect to the rotary drive unit 40 when the spool 42 moves upward in FIG. 2, and hydraulic oil is supplied to rotate the rotary attachment in the other direction with respect to the rotary drive unit 40 when the spool 42 moves downward in FIG. 2.

The rear cover 5 is provided with a secondary relief valve 7.

The load pressure of the lift cylinder 20 used for the function of lifting and lowering the fork is larger than the load pressure of the tilt cylinder 30 and the load pressure of the rotary drive unit 40. The main relief valve 6 provided to the front cover 1 has a relief characteristic corresponding to the pressure of the hydraulic oil supplied to the fluid control valve 2 having the maximum load pressure. By contrast, the load pressure of the tilt cylinder 30 used for the function of tilting the fork and the load pressure of the rotary drive unit 40 used for the function of rotating the rotary attachment are smaller than the load pressure of the lift cylinder 20. The secondary relief valve 7 provided to the rear cover 5 has a relief characteristic corresponding to the pressure of the hydraulic oil supplied to the fluid control valves 3 and 4.

A load handling line 122 of the fluid control valve 2 having the maximum load pressure among the fluid control valves 2, 3, and 4, the main relief valve 6, and the pressure compensation valves 21, 31, and 41 in the fluid control valves 2, 3, and 4 are connected through a first passage 101 functioning as a load sensing passage and a main relief passage. Load handling lines 132 and 142 of the fluid control valves 3 and 4 other than the fluid control valve 2 having the maximum load pressure among the fluid control valves 2, 3, and 4 and the secondary relief valve 7 are connected through a second passage 102 functioning as a load sensing passage and a secondary relief passage.

A check valve (no-return valve) 92 is disposed between the load handling line 132 of the fluid control valve 3 and the second passage 102. A check valve 93 is disposed between the load handling line 142 of the fluid control valve 4 and the second passage 102. Between the first passage 101 and the second passage 102, a shuttle valve 91 is disposed as a passage switching unit to send the hydraulic oil having a higher pressure out of the hydraulic oil in the second passage 102 and the hydraulic oil in the load handling line 122 of the fluid control valve 2 to the main relief valve 6 and the pressure compensation valves 21, 31, and 41 in the respective fluid control valves 2, 3, and 4 through the first passage 101.

Figure 3:
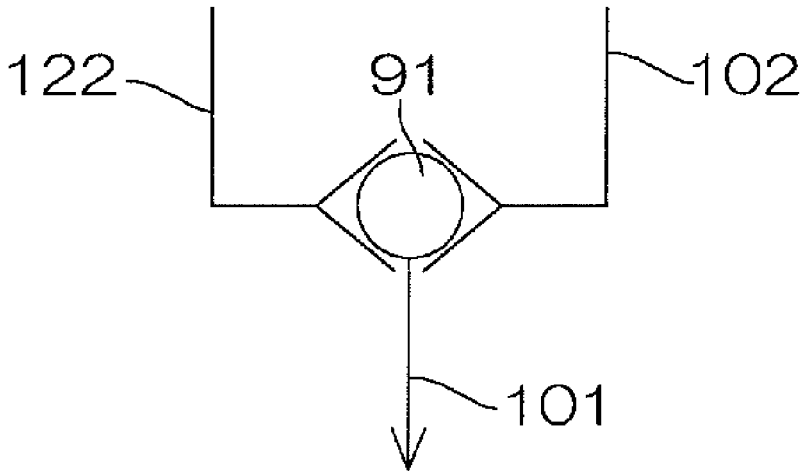
FIG. 3 is an explanatory diagram illustrating a configuration for switching the passage of hydraulic oil using a shuttle valve 91.

FIG. 3 is an explanatory diagram illustrating a configuration for switching the passage of hydraulic oil using the shuttle valve 91.

One supply port of the shuttle valve 91 is connected to the load handling line 122 of the fluid control valve 2 having the maximum load pressure among the fluid control valves 2, 3, and 4. The other supply port of the shuttle valve 91 is connected to the load sensing passage connected to the secondary relief valve 7 and the second passage 102 functioning as the secondary relief passage. A discharge port of the shuttle valve 91 is connected to the load sensing passage connected to the main relief valve 6 and the first passage 101 functioning as the main relief passage. As a result, the passage having a higher pressure of the hydraulic oil, out of the load handling line 122 and the second passage 102, is connected to the first passage 101.

Figure 4:
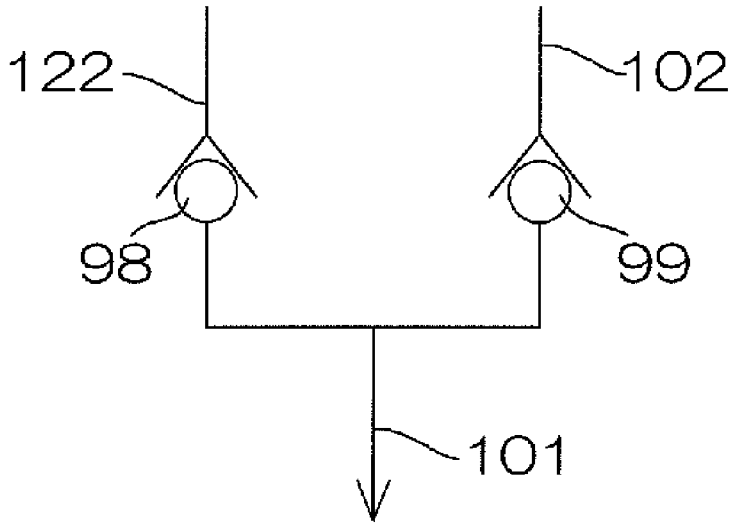
FIG. 4 is an explanatory diagram illustrating a configuration for switching the passage of hydraulic oil using a pair of check valves 98 and 99.

FIG. 4 is an explanatory diagram illustrating a configuration for switching the passage of hydraulic oil using a pair of check valves 98 and 99.

The embodiment illustrated in FIGS. 2 and 3 employs a configuration in which a passage having a higher pressure of the hydraulic oil, out of the load handling line 122 and the second passage 102, is connected to the first passage 101 using the shuttle valve 91 as a passage switching unit. In place of the shuttle valve 91, as illustrated in FIG. 4, the check valve 98 is disposed between the load handling line 122 of the fluid control valve 2 having the maximum load pressure, among the fluid control valves 2, 3, and 4, and the first passage 101 connected to the main relief valve 6 and functioning as the load sensing passage and the main relief passage, whereas the check valve 99 is disposed between the second passage 102 connected to the secondary relief valve 7 and functioning as the load sensing passage and the secondary relief passage and the first passage 101, which enables an action similar to that obtained with the shuttle valve 91 illustrated in FIG. 3 to be obtained.

In the fluid control device having the above-described configuration, when the fluid control valve 2 having the maximum load pressure for driving the lift cylinder 20 for the function of raising and lowering the fork is opened and closed, the port pressure of the fluid control valve 2 is guided to the main relief valve 6 through the first passage 101, and its maximum pressure is controlled by the main relief valve 6. At the same time, the port pressure of the fluid control valve 2 is guided to the pressure compensation valves 21, 31, and 41 of the respective fluid control valves 2, 3, and 4. As a result, even when functions having different load pressures are simultaneously operated in the fluid control valves 2, 3, and 4, constant operability can be always secured without depending on the load pressures. Since the shuttle valve 91 is disposed between the first passage 101 and the second passage 102, the port pressure of the fluid control valve 2 is not guided to the secondary relief valve 7.

In addition, when the fluid control valve 3, which drives the tilt cylinder 30 for the function of tilting the fork, is opened and closed, the port pressure of the fluid control valve 3 is guided to the secondary relief valve 7 through the second passage 102, and is also guided to the main relief valve 6 and the pressure compensation valves 21, 31, and 41 of the respective fluid control valves 2, 3, and 4 through the first passage 101. In this process, the set pressure for the secondary relief valve 7 is smaller than the set pressure for the main relief valve 6, and thus the maximum pressure of the fluid control valve 3 is controlled by the secondary relief valve 7.

Similarly, when the fluid control valve 4, which drives the rotary drive unit 40 for the function of rotating the rotary attachment, is opened and closed, the port pressure of the fluid control valve 4 is guided to the secondary relief valve 7 through the second passage 102, and is also guided to the main relief valve 6 and the pressure compensation valves 21, 31, and 41 of the respective fluid control valves 2, 3, and 4 through the first passage 101. In this process, the set pressure for the secondary relief valve 7 is smaller than the set pressure for the main relief valve 6, and thus the maximum pressure of the fluid control valve 4 is controlled by the secondary relief valve 7.

When the fluid control valve 3 and the fluid control valve 4 are simultaneously opened and closed, the action of the check valve 92 and the check valve 93 causes the higher port pressure of the fluid control valve 3 and the fluid control valve 4 to be guided to the secondary relief valve 7 through the second passage 102, and also guided to the main relief valve 6 and the pressure compensation valves 21, 31, and 41 of the respective fluid control valves 2, 3, and 4 through the first passage 101.

By contrast, when the fluid control valve 2 having the maximum load pressure and the fluid control valve 3 or the fluid control valve 4 are simultaneously opened and closed, the action of the shuttle valve 91 functioning as the passage switching unit described above causes the port pressure of the fluid control valve 2 having the maximum load pressure to be guided to the pressure compensation valves 21, 31, and 41 of the respective fluid control valves 2, 3, and 4. As a result, even when functions having low load pressures are simultaneously operated in the fluid control valve 3 or the fluid control valve 4, constant operability can be always secured without depending on the load pressures.

In this process, the action of the shuttle valve 91 causes the maximum pressure of the fluid control valve 2 to be controlled by the main relief valve 6 and the maximum pressure of the fluid control valve 3 or the fluid control valve 4 to be controlled by the secondary relief valve 7.

In the fluid control device having such a configuration, since the load sensing passages for each of the fluid control valves 2, 3, and 4 also serve as the relief passage to the secondary relief valve 7 or the relief passage to the main relief valve 6, the size of the entire fluid control device can be reduced, and the number of processing steps of the device can be reduced, the number of parts can be reduced, and the number of assembly steps can be reduced accordingly.

In addition, since the main relief valve 6 having the relief characteristic corresponding to the pressure of the hydraulic oil supplied to the fluid control valve 2 having the maximum load pressure and the secondary relief valve 7 having the relief characteristic corresponding to the pressure of the hydraulic oil supplied to the fluid control valves 3 and 4 are used, it is possible to obtain an optimum pressure without giving priority to either high or low pressure even when a function in which the high pressure acts and another function in which the low pressure acts are simultaneously operated.

What is claimed is:

1. A fluid control device of a closed center circuit type having a configuration in which a plurality of fluid control valves are arranged in a row, the fluid control valves each including a body having a port connected to an actuator, a flowrate adjusting member configured to adjust a flowrate of a hydraulic fluid passing through a flow path formed in the body, and a pressure compensation valve, the fluid control device comprising:

a main relief valve corresponding to a pressure of a hydraulic fluid supplied to a fluid control valve having a maximum load pressure among the plurality of fluid control valves;

a secondary relief valve corresponding to a pressure of a hydraulic fluid supplied to a plurality of fluid control valves other than the fluid control valve having the maximum load pressure among the plurality of fluid control valves;

a first passage connecting a load handling line of the fluid control valve having the maximum load pressure among the plurality of fluid control valves, the main relief valve, and the pressure compensation valves in the plurality of respective fluid control valves;

a second passage connecting load handling lines of the plurality of fluid control valves other than the fluid control valve having the maximum load pressure among the plurality of fluid control valves and the secondary relief valve;

check valves disposed in respective passages connecting the load handling lines of the plurality of fluid control valves other than the fluid control valve having the maximum load pressure among the plurality of fluid control valves and the second passage; and a passage switching unit configured to send a hydraulic fluid having a higher pressure out of the hydraulic fluid in the load handling line of the fluid control valve having the maximum load pressure among the plurality of fluid control valves and the hydraulic fluid in the second passage to the main relief valve and the pressure compensation valves in the plurality of respective fluid control valves through the first passage.

2. The fluid control device according to claim 1, wherein the passage switching unit is a shuttle valve having a supply port connected to the second passage and the load handling line of the fluid control valve having the maximum load pressure among the plurality of fluid control valves, and a discharge port connected to the first passage.

3. The fluid control device according to claim 1, wherein the passage switching unit includes a check valve disposed between the second passage and the first passage, and a check valve disposed between the load handling line of the fluid control valve having the maximum load pressure among the plurality of fluid control valves and the first passage.

4. The fluid control device according to claim 1, wherein the flowrate adjusting member is a spool that moves in the body.

* * * * *